US008893731B2

(12) United States Patent
Pires et al.

(10) Patent No.: US 8,893,731 B2
(45) Date of Patent: Nov. 25, 2014

(54) CONTAINER SYSTEM

(71) Applicants: Leo Clifford Pires, Basking Ridge, NJ (US); Roger Hwang, Maple (CA); Swati Kharbanda, Faridabad (IN); Iti Seth, New Delhi (IN); Rajesh Deswal, Rohtak (IN)

(72) Inventors: Leo Clifford Pires, Basking Ridge, NJ (US); Roger Hwang, Maple (CA); Swati Kharbanda, Faridabad (IN); Iti Seth, New Delhi (IN); Rajesh Deswal, Rohtak (IN)

(73) Assignee: Zen Design Solutions Limited, Kowloon, Hong Kong (CN)

( * ) Notice: Subject to any disclaimer, the term of this patent is extended or adjusted under 35 U.S.C. 154(b) by 0 days.

(21) Appl. No.: 13/654,520

(22) Filed: Oct. 18, 2012

(65) Prior Publication Data

US 2013/0152962 A1 Jun. 20, 2013

(30) Foreign Application Priority Data

Dec. 20, 2011 (IN) ..... 3730/DEL/2011

(51) Int. Cl.
*A45D 33/00* (2006.01)
*A45D 33/26* (2006.01)

(52) U.S. Cl.
CPC ..... *A45D 33/006* (2013.01); *A45D 33/26* (2013.01)
USPC ..... 132/294; 132/320; 132/314; 206/209; 206/581; 15/257.05; 401/125

(58) Field of Classification Search
CPC ..... A45D 40/00; A45D 40/24; A45D 40/18; A45D 40/26; A45D 33/006; A45D 33/18; A45D 33/28; A45D 2200/1018; A45D 2200/1036; A45D 2200/25; A46B 15/0091; A46B 15/028; A45C 5/005; A45C 11/008
USPC ..... 132/286–300, 313, 314, 317, 320, 303; 206/581, 235, 823, 207, 209; 220/507, 220/553, 555, 505; 401/123, 125; 15/235.3, 15/235.7, 235.8, 257.05, 104.92
See application file for complete search history.

(56) References Cited

U.S. PATENT DOCUMENTS

| | | | | | |
|---|---|---|---|---|---|
| 1,978,905 | A | * | 10/1934 | Lamb et al. | 362/156 |
| 2,783,489 | A | * | 3/1957 | Bogoslowsky | 401/129 |
| 3,332,429 | A | * | 7/1967 | Bates | 132/317 |
| 3,499,540 | A | * | 3/1970 | Huncovsky | 211/60.1 |
| 3,637,278 | A | | 1/1972 | Easterbrooks | |
| 4,555,020 | A | | 11/1985 | Campello et al. | |
| 4,650,672 | A | | 3/1987 | Yagita et al. | |
| 4,898,195 | A | | 2/1990 | Sussman | |
| D307,810 | S | | 5/1990 | Gavin | |
| D317,566 | S | * | 6/1991 | Garganese | D9/420 |
| D397,831 | S | | 9/1998 | Stoecker | |
| 6,412,640 | B1 | | 7/2002 | Destanque et al. | |
| 7,316,235 | B2 | * | 1/2008 | Maio et al. | 132/293 |
| 7,461,992 | B2 | * | 12/2008 | Griffon | 401/266 |

(Continued)

*Primary Examiner* — Robyn Doan
*Assistant Examiner* — Tatiana Nobrega
(74) *Attorney, Agent, or Firm* — Patterson & Sheridan, LLP

(57) ABSTRACT

Embodiments of the present invention generally relate to a container system. More particularly the invention relates to the container system for storing at least two products of same or different type/color, and at least one applicator. The container system of the present invention is configured to comprise at least two receptacles for storing the products, and substantially abutting each other and at least one applicator configured to pick up the products stored in the receptacles simultaneously. The invention also relates to the container system for holding consumer products such as cosmetic or care products and is aimed at providing single or multiple makeup effects on the skin, face, lips, eyes and the like.

10 Claims, 14 Drawing Sheets

(56) References Cited

U.S. PATENT DOCUMENTS

| | | | | |
|---|---|---|---|---|
| 8,215,318 | B2 * | 7/2012 | Jacob | 132/208 |
| 2002/0056660 | A1 * | 5/2002 | Gueret | 206/525 |
| 2004/0129292 | A1 * | 7/2004 | Petit | 132/293 |
| 2005/0072355 | A1 * | 4/2005 | Petit | 118/255 |
| 2007/0267038 | A1 * | 11/2007 | Maille | 132/317 |
| 2007/0289603 | A1 * | 12/2007 | Thorpe | 132/296 |
| 2009/0255846 | A1 * | 10/2009 | Pires et al. | 206/581 |
| 2013/0104927 | A1 * | 5/2013 | Hurst | 132/221 |

* cited by examiner

CONTAINER SYSTEM

CROSS-REFERENCE TO RELATED APPLICATION

This application claims benefit of Indian Provisional Application Ser. No. 3730/DEL/2011, filed Dec. 20, 2011, which is incorporated by reference in its entirety.

BACKGROUND

1. Field of the Invention

Embodiments of the present invention generally relate to a container system. More particularly the invention relates to a system comprising at least two products of same or different type/color, and at least one applicator. The invention also relates to the container system for holding consumer products such as cosmetic or care products and is aimed at providing single or multiple makeup effects on the skin, face, lips, eyes and the like.

2. Description of the Related Art

Various cosmetic containers are known in the art that are used for storing foundation, face powder, blush, lip stick, rouge, cake mascara, colored substance to style eyelids and other parts of the user's body.

In general, these cosmetic containers include a base formed as a tray with one or more small receptacles or palettes in which a cosmetic composition is stored typically in compressed form. The cosmetic containers further include a cover that lies over the base and encase the compositions stored in the receptacles so that the compositions do not exsiccate, spill, or contaminate. Generally, the base and cover of such cosmetic containers are hinged together along one side to enable the opening and closing of said cosmetic containers. The cosmetic containers are also provided with closure means that enable the user to manually open and close the cosmetic container as per the requirement.

There exists many known cosmetic containers in field of cosmetic packaging; the one disclosed in U.S. Pat. No. 3,637,278 issued to Easterbrooks discloses a cosmetic container of a relatively small size which can be easily carried in a woman's purse/handbag. The container is provided with multiple compartments for receiving the products such as eye makeup products. The container is simple to use and inexpensive to manufacture but since the container does not include an applicator for applying the products stored in the container therefore the user has to carry a separate applicator for applying the eye makeup.

U.S. Pat. No. 4,555,020 issued to Campello discloses a cosmetic container which is used for storing a plurality of articles of convenience. It has a central hinged top portion for storing certain cosmetic articles along with a plurality of side compartments for receiving other cosmetic products. The hinged top includes a mirror to facilitate personal grooming.

U.S. Pat. No. 4,898,195 issued to Sussman discloses a cosmetic container with a sliding drawer having a set of receptacles for storing compatibly-colored cosmetics. The drawer storing a particular kind of product can be replaced by another drawer of the same or different product upon the choice of the user. This allows the user to carry along a different set of cosmetics products with them stored in the replaceable drawers and thus avoids the need for using several cosmetic containers with each storing a particular kind of product.

U.S. Pat. No. D 307,810 issued to Ellen discloses a design of a cosmetic container which is provided with two receptacles for cosmetic composition of different colors along with two applicators.

U.S. Pat. No. D 397,831 issued to Joanne Stoecker discloses a design of a cosmetic container which is provided with four receptacles for storing cosmetic composition of different colors along with two applicators.

U.S. Pat. No. 6,412,640 issued to Destanque discloses a cosmetic container having two compartments with two separate lids for storing two separate products respectively. The two lids are individually articulated to the base such that a first compartment containing, for example, a foundation, may be accessible by lifting a first lid, while a second compartment containing an eye composition may be uncovered by lifting a second lid. The bottom of the container may have an additional compartment for housing an applicator member such as a brush or a puff.

U.S. Pat. No. 4,650,672 issued to Yagita discloses a cosmetic formed by mixing differently colored pigment compositions with binders to form differently colored grains, intermixing the grains and compression-moulding them into a compact. The differently colored grains may then separately or simultaneously be applied to the skin with a puff.

As discussed above most of the known cosmetic containers in the art are provided with one or more compartments for storing the products of different colors, with one or more applicators.

But in all of the above known cosmetic containers, either there is a single applicator provided for picking up all the products stored in the container or multiple applicators for multiple products such that each applicator is configured to pick and apply a particular kind of product stored. This implies that in case of a single applicator, the user has to first pick one product with the applicator, apply it on the skin, clean the applicator and then again follow the same procedure to pick the second product with the same applicator to apply the second composition on the skin.

Further the cosmetic containers having multiple applicators suffer with the disadvantages that the user has to handle different applicators for applying different products and it is cumbersome. Also there is a great probability that one of the applicators get misplaced by the user.

Also, in cases where the same applicator is used to pick different compositions, there is a possibility that the compositions are overlaid on the applicator and this results in contamination of compositions and also degrades the quality of makeup applied.

Therefore, it is desirable to provide a cosmetic container of the type which does not have the drawbacks mentioned herein above.

Now days, women are trying to have multiple makeup effects on the skin. Therefore it is the need of the day that there should be available a cosmetic container which can provide multiple makeup effects with even less number of applicators and brushes.

The present invention is directed to avoid the above mentioned drawbacks and to meet the present day needs.

SUMMARY

The present invention relates to a system of simultaneous loading of a plurality of products onto a plurality of application surfaces of an applicator element. The present invention is aimed at providing single or multiple makeup effects on the skin, face, lips, eyes and the like.

According to an embodiment of the present invention there is provided a system having a plurality of products and at least one applicator. Each of the plurality of products has a top surface, a bottom surface and at least one side surface. The products are placed adjacent to each other such that the at least one side surface of each of the products substantially abuts with each other, and a shape is formed by top surfaces of the products abutting each other. According to an alternate embodiment, the products are placed close to each other such that at least one side surface of each of the products lie close to each other but does not touch or abut each other. The shape formed by top surfaces of the plurality of products abutting each other is complimentary to a shape of the applicator element for applying the products such that the applicator element is able to pick each of the plurality of products simultaneously. The present invention is aimed at providing single or multiple makeup effects on the skin, face, lips, eyes and the like of the user.

According to an embodiment of the present invention there is provided a container system having a plurality of receptacles for storing one or more products and at least one applicator. Each of the receptacles has an open top end, a bottom wall and at least one sidewall. The receptacles are placed adjacent to each other such that the at least one side wall of each of the receptacles substantially abuts with each other, and an internal shape is formed by the receptacles abutting each other. The internal shape formed by the receptacles abutting each other is adapted to outer shape of the applicator element for applying the products such that the applicator element is able to pick the product stored in each of the receptacles simultaneously. The present invention is aimed at providing single or multiple makeup effects on the skin, face, lips, eyes and the like of the user.

According to another embodiment of the invention, the pluralities of receptacles are placed adjacent to each other such that there is provided an empty space between them to allow mixing of the products stored in the receptacles.

According to another embodiment of the invention there is provided a container system comprising a base member, a cover member and an applicator. A locking means operatively interconnects the base member of the container system with the cover member for providing relative rotational movement to open and close the container system. The base member and the cover member can be connected by a suitable locking attachment means including a hinge, a snap, a hook, a screw, a magnet or any other suitable means. In an alternative embodiment of the invention, the cover member may have a small mirror mounted on its inner wall and a base member for storing the makeup material, or an electronic data book equipped with liquid crystal displays and keyboard receptacle. The base member comprises a plurality of receptacles for storing the products and at least one applicator.

According to another embodiment of the invention there is provided a system comprising a plurality of products and at least one applicator. The products are placed adjacent to each other such that an angle formed between the top surfaces of the adjacent products may be less than 180 degree or greater than 180 degree. According to an alternate embodiment of the present invention, the side surfaces of adjacent products may lie close to each other but may not necessarily touch or abut each other. Further, at least one product of the plurality of products is arranged such that its top surface makes a non-zero angle with respect to the base member. The pluralities of the products adjacent to each other may be arranged to form a square shape, a polygon shape including pentagon shape, hexagon shape, and the like. In an alternate embodiment of the invention, the plurality of products may be arranged to make a "V" shape.

According to another embodiment of the invention there is provided a container system comprising a base member including a plurality of receptacles wherein each receptacle stores one or more products, and wherein at least one receptacle is arranged in the base member of the container system such that the bottom wall of said receptacle makes a non-zero angle with the base member and/or with the bottom wall of the other receptacle of the container system storing the product. It would be apparent to a person skilled in the art that the bottom wall of the receptacle comprises two surfaces namely a surface facing the product and another surface facing the base member. It is the surface of the bottom wall facing the product that makes a non-zero angle with the base member and is parallel to the top surface of the product contained within the receptacle. Henceforth, the two terms "bottom wall" of the receptacle and "the surface of the bottom wall facing the product" has been used synonymously. The pluralities of receptacles are substantially abutted to each other and may be arranged perpendicularly to the base member. In a preferred embodiment of the invention, the receptacles may be arranged at an angle of less than 90 degree or greater than 90 degree with respect to other receptacles or with respect to the base member of the container system. In a more preferred embodiment of the invention, the receptacles may be arranged at an angle of less than 180 degree or greater than 180 degree with respect to other receptacles or with respect to the base member of the container system. The plurality of receptacles may be arranged to form a pentagon shape, hexagon shape, and the like. In an alternate embodiment of the invention, the receptacles may be arranged to make a "V" shape.

According to another embodiment of the invention there is provided a container system comprising a base member including a plurality of receptacles for storing the product wherein the receptacles are either static or dynamic in nature. In an alternate embodiment, the base member of the container system can include a combination of the static and dynamic receptacles. According to an alternate embodiment of the invention there is provided a container system comprising a base member including a plurality of receptacles for storing the product wherein the distance between the adjoining/adjacent receptacles can be varied by a suitable adjustment means. The suitable adjustment means may include a biasing member placed between the adjacent receptacles so that a force applied on the biasing member changes the distance between the adjoining/adjacent receptacles. The suitable adjustment means may also include a magnet placed between the adjacent receptacles.

According to another embodiment of the invention there is provided a container system comprising a base member including a plurality of receptacles for storing the product and an applicator wherein the shape of the receptacles can be modified/changed by a suitable adjustment means to correspond to the shape of the applicator. In an alternate embodiment, the shape of the applicator can be adjusted to adapt to the shape of the receptacle storing the product.

According to another embodiment of the invention there is provided a container system comprising a base member including a plurality of receptacles having non-uniform shape for storing the product and at least one applicator such that an internal shape of the combination of receptacles abutting each other corresponds to the outer shape of the applicator such that the applicator is able to pick up the product stored in each of the receptacles simultaneously.

According to another embodiment of the invention there is provided a container system comprising at least one applicator wherein the applicator may have a single application surface or multiple application surfaces. In yet another embodiment of the invention there is provided a container system comprising at least one applicator having a plurality of application surfaces wherein each of the application surfaces will pick the product stored in the corresponding receptacle, thereby picking different products on each of the application surfaces. This type of configuration of the applicator and the receptacles will allow the user to pick different products on the different application surfaces of the same applicator at a single time.

According to another embodiment of the present invention there is provided a system comprising at least one applicator having an applicator element with a plurality of application surfaces; and a plurality of products comprising a top surface, a bottom surface and at least one side surface; wherein at least one side surface of at least two products of the plurality of products lie adjacent to each other such that their top surfaces form an angle less than 180 degree with respect to each other and at least two application surfaces of the plurality of application surfaces of the applicator element abut each other to form an angle greater than 180 degree. The at least two application surfaces of the plurality of application surfaces abutting each other form a shape complimentary to a shape formed by the at least two products of the plurality of products placed adjacent to each other, to enable simultaneous loading of each of the at least two products of the plurality of products on each of the corresponding at least two application surfaces of the plurality of application surfaces of the applicator. In an alternate embodiment of the present invention, the at least two application surfaces of the plurality of application surfaces that are adjacent to each other may or may not abut each other.

According to an alternate embodiment of the present invention, at least one side surface of each of the at least two products of the plurality of products lie adjacent to each other such that their top surfaces form an angle greater than 180 degree with respect to each other and at least two application surfaces of the plurality of application surfaces of the applicator element abutting each other form an angle less than 180 degree.

In yet another embodiment of the invention there is provided a system comprising at least one applicator having a plurality of application surfaces wherein each of the application surfaces can be made of the same material or different materials having the same or different physical and chemical properties. The different application surfaces of the applicator element could be made of different materials that may have different stiffness, different tactile feel, different color, different chemical nature, different magnetic property, different temperature property and/or other property.

According to another embodiment of the invention there is provided a system comprising at least one applicator wherein the applicator is either static or dynamic in nature.

According to another embodiment of the invention there is provided an adjustable applicator for curving/adjusting the applicator wherein the user has more control over the curved angle achieved in the applicator to adapt to the shape of the receptacle storing the product.

According to another embodiment of the invention, there is provided a container system comprising at least one dynamic applicator having a plurality of application surfaces such that the user can selectively use the application surfaces of choice for picking and applying the product and at the same time hiding the application surfaces which are not to be brought in contact with the product stored or with the user's skin. The dynamic nature of the applicator helps in selecting the application surface of choice from the plurality of application surfaces provided for picking the specific products from the receptacles and applying to the skin of the user. The dynamic nature of the applicator can be achieved by using a biasing member or a magnet.

According to yet another embodiment of the invention there is provided a container system comprising a dynamic applicator with plurality of application surfaces, wherein the dynamic applicator is made up of a suitable deformable material wherein the shape of the dynamic applicator is changed and adapted to form the shape of the receptacles storing the product.

The present invention is advantageous in a way that there is provided a container system which can be used to apply either one product or more than one product on the skin, face, lips or eyes simultaneously. Further the configuration of the applicator and the receptacles of the container system are such that the applicator is able to pick up one or more products of same or different type/color simultaneously and thereby avoiding reloading of the applicator.

Thus, the present invention provides for a simplified, cost-effective, inexpensive, and efficient container system.

The container system of the present invention may be used to store a wide variety of consumer and industrial products related to cosmetic, skin care, hair care, oral care, personal care, pharmaceutical, wound care, orally administrable products, home-care or adhesives. The term products is further intended to include cosmetic compositions, as known in the cosmetic arts, especially powder compositions in the form of a cake powder also known as a pressed powder, for example face powder, eye shadow, rouge, foundation, blush, cake mascara, lip stick, and the like. The products can be physically or chemically different in nature. The products of the present invention can be applied on skin, face, lips, eyes and the like.

These and further aspects which will be apparent to the expert of the art are attained by a container system in accordance with the drawings of the present invention.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
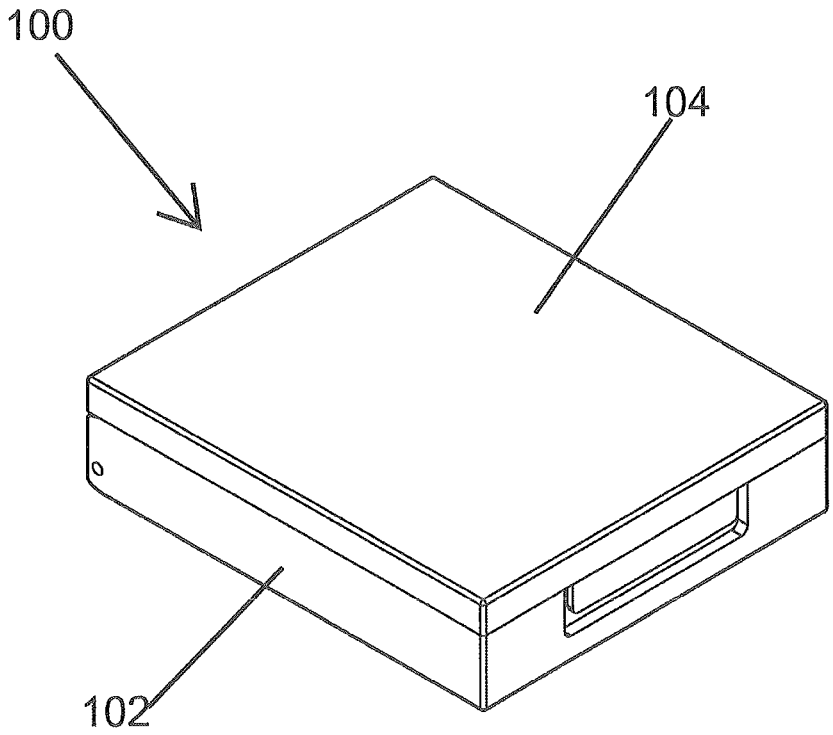
FIG. 1 illustrates a perspective view of the container system 100 in closed position according to one embodiment of the invention.

To facilitate understanding, identical reference numerals have been used, where possible, to designate identical elements that are common to the figures. It is to be noted, however, that the appended drawings illustrate only typical embodiments of this invention and are therefore not to be considered limiting of its scope, for the invention may admit to other equally effective embodiments.

DETAILED DESCRIPTION

The container system according to one embodiment of the present invention is shown in FIG. 1 to FIG. 6.

Figure 2:
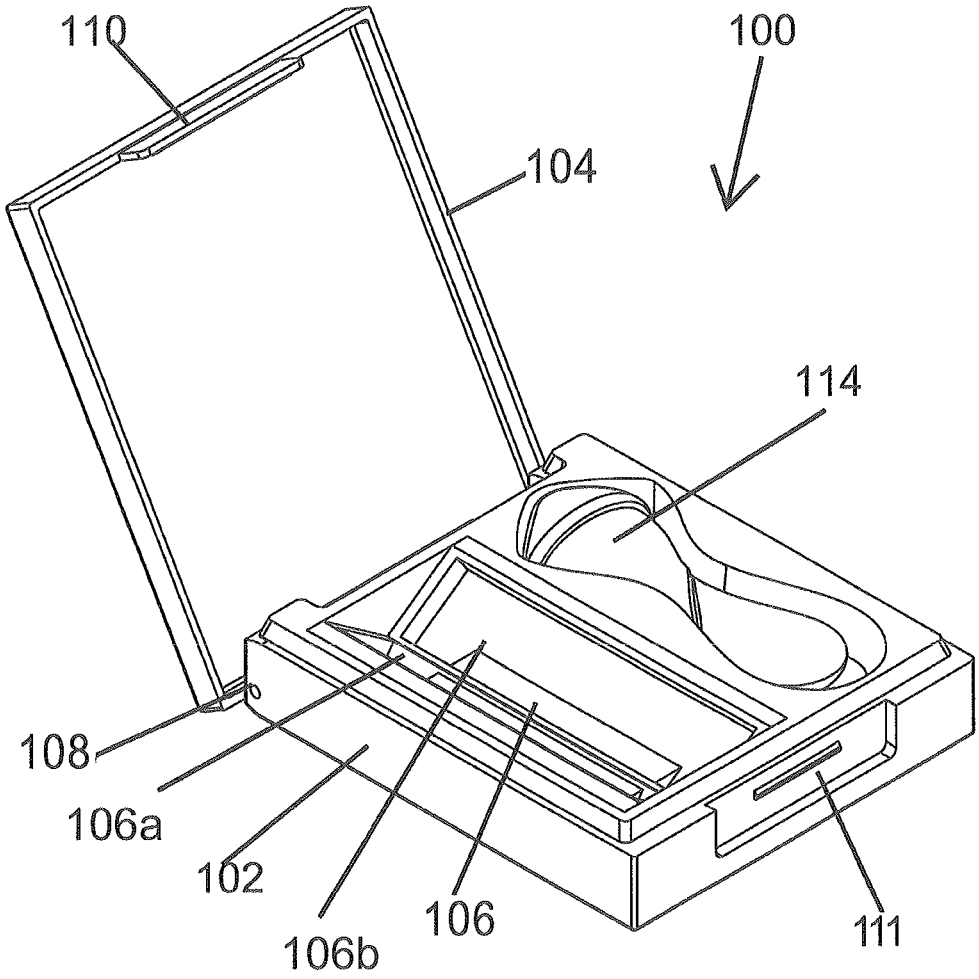
FIG. 2 illustrates the perspective view of the container system 100 of FIG. 1 in open position.

FIG. 1 and FIG. 2 illustrate a perspective view of a container system (system) 100 in its closed state and open state respectively, with respect to one embodiment of the present invention. As embodied herein and shown in FIG. 1 and FIG. 2, the container system 100 includes a base member 102, and a cover member 104. In an alternate embodiment of the invention, the container system 100 may include any number of intermediate members between the base member 102 and the cover member 104. The base member 102 includes a receptacle assembly 106 for storing the product. The receptacle assembly 106 includes a receptacle 106*a* and a receptacle 106*b*. The receptacle 106*a* and the receptacle 106*b* are formed within the base member 102 such that substantial space is provided at the outer periphery of the base member 102, thereby allowing the user to hold the base member 102 from the space provided at its periphery. The base member 102 and the cover member 104 are operatively interconnected to each other by means of a locking assembly 108 to provide relative rotational movement. The locking assembly 108 further allows the user to open and lock the cover member 104, and the base member 102 of the container system 100 with respect to each other.

The cover member 104 includes a closure 110 configured to interact, by snap fitting, with a complementary portion 111 formed in the base member 102. The closure 110 includes a tab extending in the direction of the base member 102, substantially at ninety degrees with respect to the plane of the cover member 104. The closure 110 is used to release the cover member 104 and the base member 102, and therefore operate the opening and closing of the aforementioned members of the container system 100. In the closed position of the container system 100, the closure 110 is configured in the cover member 104 in engagement with the complementary portion 111 formed within the base member 102. In an alternate embodiment, any other closure assembly can be used to operate the opening and closing of the base member 102 and the cover member 104 of the container system 100.

Further in the container system 100 the cover member 104 has similar dimensions of that of the base member 102 so as to draw up the boundaries of a closed volume, collectively with the base member 102. In the preferred embodiment, the inner surface of the cover member 104 has a mirror (not shown) attached thereto. In an alternate embodiment, the inner surface of the cover member 104 may preferably be a reflective surface. The cover member 104 is interconnected to the base member 102 such that the inner surface having a mirror faces towards the base member 102. This allows the user to protect the mirror and the products stored in the receptacles 106*a* and 106*b* of the container system 100 from the atmospheric dust particles and other contaminated materials present in the air when the container system 100 is in closed position.

In the preferred embodiment, the container system 100 is formed from the Acrylonitrile butadiene styrene (ABS) material. In the alternate embodiment, the container system 100 can be formed from any other suitable polymeric material or any other option available.

In the preferred embodiment, the container system 100 is of substantially rectangular shape. In an alternate embodiment, the container system 100 can be made of any shape such as square, circular, oval, or oyster shape etc.

Figure 3:
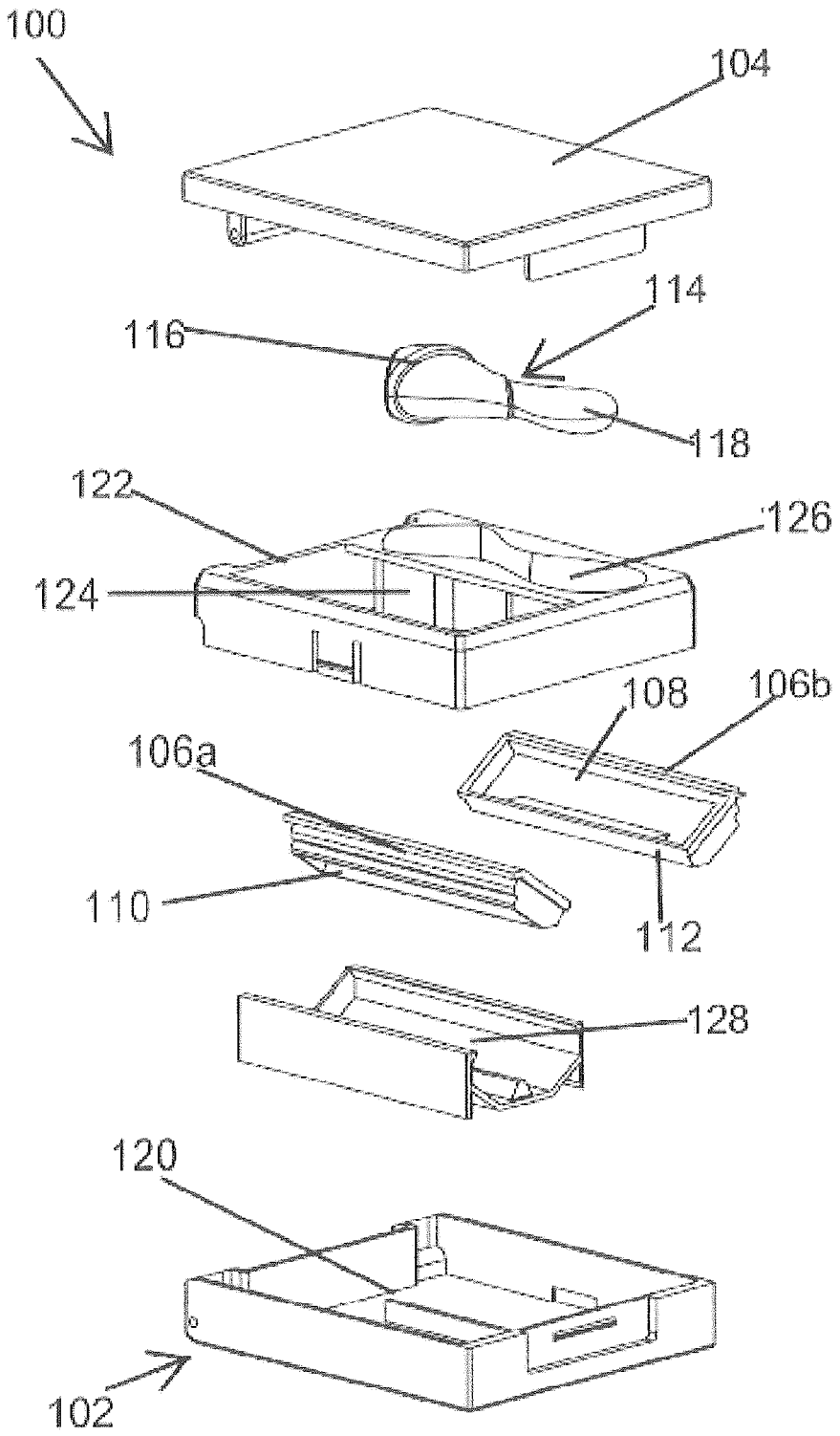
FIG. 3 illustrates the exploded view of the container system 100 of FIG. 1.

FIG. 3 illustrates an exploded view of the container system 100 with respect to one embodiment of the present invention. As shown in the FIG. 3, the container system 100 includes a base member 102 and a cover member 104. The base member 102 is made up of two part sub-assembly in the present embodiment of the invention. The said sub-assembly comprises of a base holder 120 and a base tray 122. The base holder 120 and the base tray 122 are attached to each other by a suitable fastening means such as tight fit, screw fit, snap-fit, magnet and the like. In an alternate embodiment of the present invention the base holder 120 and the base tray 122 may be formed as a single part to constitute a base member 102.

The base tray 122 is accommodated in the base holder 120 and it includes an empty space 124 formed on its inner surface for storing a receptacle holder 128 which further stores the plurality of receptacles 106*a* and 106*b*. The base tray 122 further includes an applicator storage space 126 for storing an applicator 114 to be used for applying the products stored in the receptacles 106*a* and 106*b*. The applicator 114 comprises of an applicator element 116 made up of any suitable material and a handle portion 118. The handle portion 118 may be directly connected to the applicator element 116 or in any alternate embodiment of the present invention; the handle portion 118 may be connected via a stem/rod to the applicator element 116. The applicator 114 is stored in an applicator storage space 126 defined in the base member 102 of the container system 100.

Figure 4:
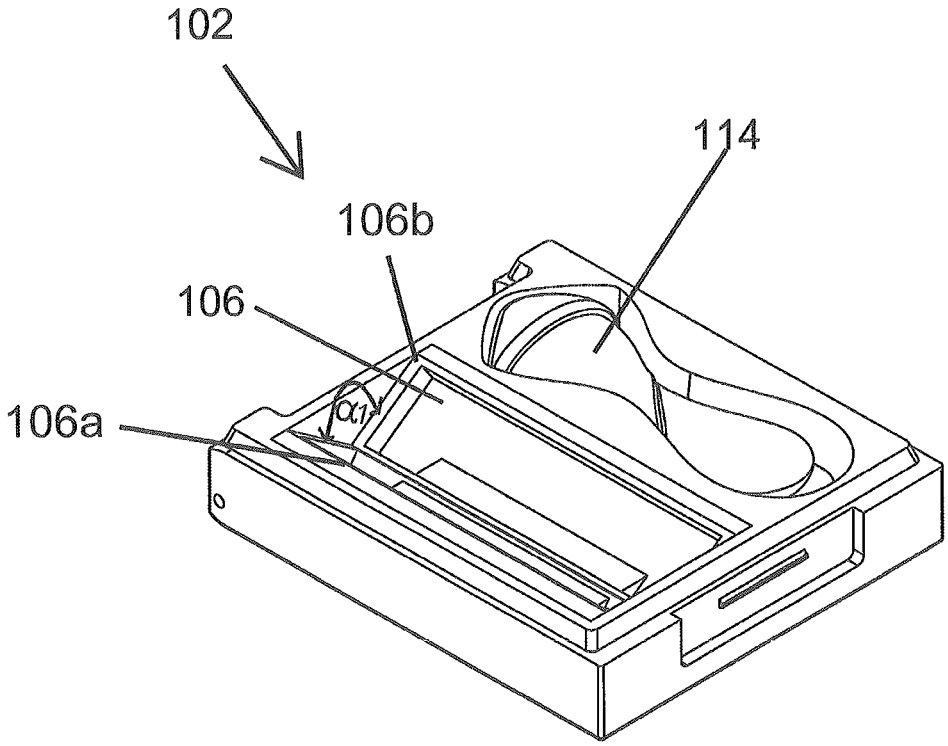
FIG. 4 illustrates the perspective view of the base member of the cosmetic container 100 of FIG. 1.

As shown in FIG. 3 and FIG. 4, the applicator storage space 126 corresponds to the outer shape of the applicator 114 such that the applicator 114 is removably disposed into the applicator storage space 126 provided in the base member 102 such that there is no extra space available to allow the movement of the applicator 114 within the storage space upon carrying the container system 100 or on the upside-downside movement of the container system 100. According to another embodiment, the applicator may be locked in the applicator storage area by suitable locking means so as to prevent the movement of the applicator outside the applicator storage area during the upside-downside movement of the container system. The suitable locking means may include a hinge, a snap, a hook, a screw, a magnet or the like. The applicator element 116 of the applicator 114 in the present embodiment is made up of any absorbent material such as sponge.

As shown in FIG. 3 and FIG. 4, each of the receptacles 106*a* and 106*b* has an outer shape that is complimentary to the internal shape of the receptacle holder 128 such that the receptacles 106*a* and 106*b* are removably accommodated in the receptacle holder 128 and there exists no extra space allowing the movement of the receptacles 106*a* and 106*b* in the receptacle holder 128. In an alternate embodiment, the receptacles 106*a* and 106*b* may be fixedly accommodated in the receptacle holder 128.

In the present embodiment, the shape of the receptacles 106*a* and 106*b* is substantially rectangular in shape but in any alternate embodiment the shape of the receptacles 106*a* and 106*b* can be square, polygon including hexagon, pentagon, curved, concave, convex and the like.

Each of the receptacles 106*a* and 106*b* of the container system 100 includes an open top end 108, a bottom wall 110 and one sidewall 112. Further each of the receptacles 106*a* and 106*b* is arranged in the receptacle holder 128 such that the sidewall 112 of each of the receptacles 106*a* and 106*b* abut with each other to form a "V" shape cross-section, and the bottom wall of each of the receptacles 106*a* and 106*b* is at a substantially non-zero angle with respect to the base member 102 of the container system 100. The side wall 112 of each of the two receptacles 106*a*, 106*b* forms an angle $\alpha 1$ with respect to each other which is less than 180 degrees. In an alternate embodiment, the receptacles may be placed such that angle $\alpha 1$ is greater than 180 degrees.

In an alternate embodiment of the present invention, there are plurality of receptacles that may be arranged to form a geometric shape selected from a triangle shape, a square shape, a polygon including a pentagon shape, a hexagon shape, a rhombus shape and the like. Each of the receptacles 106*a* and 106*b* holds/stores the product of same type of different colors, or different type of products of same or different colors.

Figure 5A:
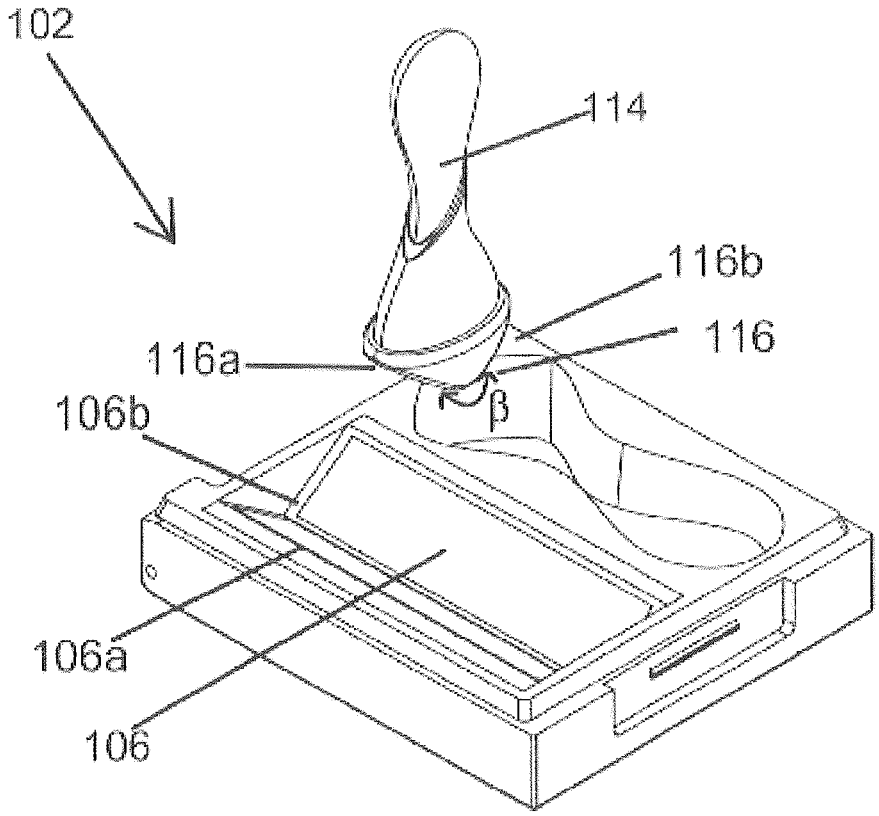
FIG. 5*a* illustrates the perspective view of the base member of the cosmetic container 100 of FIG. 4 showing the applicator removed from its storage position in the base member.
Figure 5B:
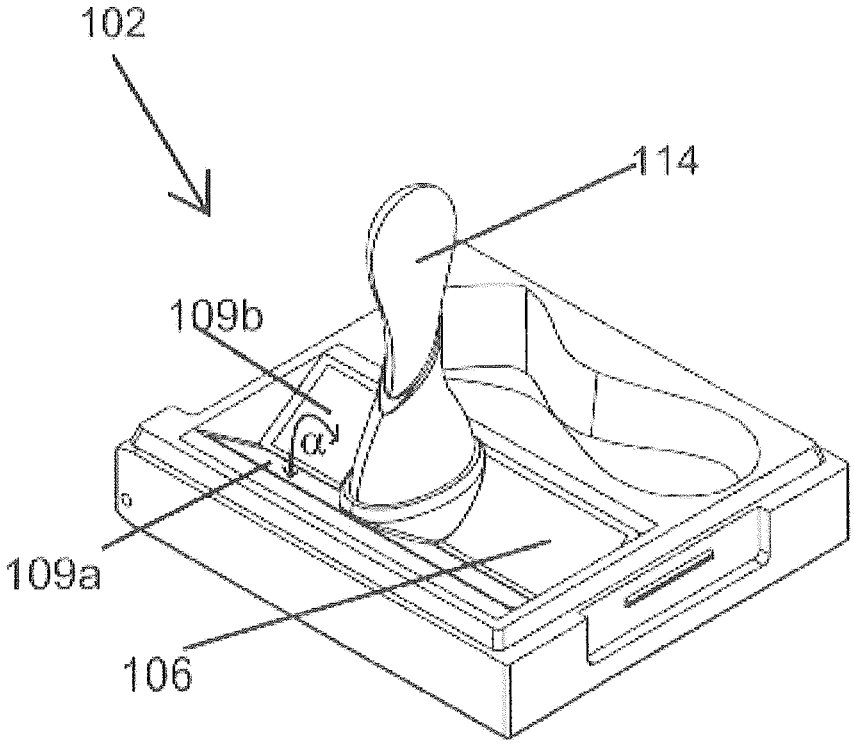
FIG. 5*b* illustrates the perspective view of the base member of the cosmetic container 100 of FIG. 4 showing the applicator picking the product from the receptacle of the base member.
Figure 6:
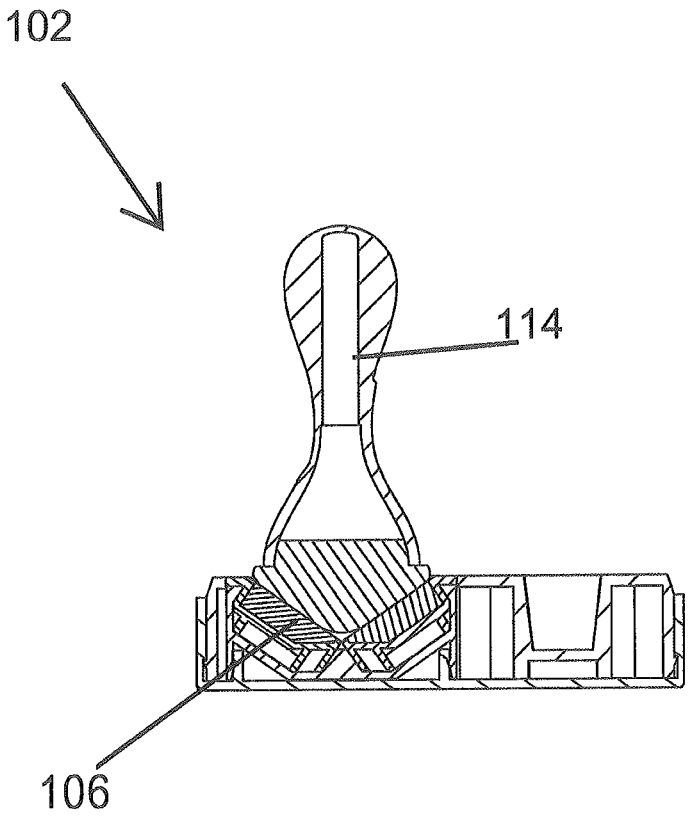
FIG. 6 illustrates the sectional view of the FIG. 5*b;*

As shown in FIG. 5*a* to FIG. 6, the outer shape of the applicator element 116 corresponds to the internal shape of the receptacles 106*a* and 106*b* arranged adjacent/adjoining to each other and thereby allowing the user to pick up the products stored in each of the receptacles 106*a* and 106*b* simultaneously. The receptacles 106*a* and 106*b* stores products 109*a* and 109*b* respectively. The two products 109*a* and 109*b* are placed adjacent to each other such that their side surfaces abut each other and their top surfaces make an angle $\alpha$ with respect to each other. In an alternate embodiment of the present invention, the side surfaces of the products may not touch or abut each other. The value of a can vary between $1° \geq \alpha < 180°$. In an alternate embodiment of the present invention, the value of a may be greater 180°. It will be apparent to a person skilled in the art that if the plurality of products are placed such that the side surfaces of at least two products do not abut each other, then angle $\alpha$ is formed between the planes of the top surfaces of the at least two products. Further, each of the two products 109*a* and 109*b* are arranged such that their top surfaces make a non-zero angle with respect to the base member. The application element 116 includes two application surfaces 116*a* and 116*b* abutting each other to form an angle $\beta$ which is greater than 180° with respect to each other (not shown). In an alternate embodiment of the present invention, angle $\beta$ may be less than 180°. In another alternate embodiment of the present invention, at least two application surfaces of the plurality of application surfaces that are adjacent to each other may or may not abut each other. The arrangement of application surfaces 116*a*, 116*b* and the products 109*a*, 109*b* enables simultaneous loading of each of the two products 109*a*, 109*b* on to the respective application surfaces 116*a*, 116*b* of the applicator element 116. As shown in FIG. 5*a*, the application surfaces 116*a*, 116*b* of the applicator element 116 form a V shape corresponding to a V shape formed by top surfaces of products 109*a*, 109*b* abutting each other. As the applicator 114 is swiped through the space between the receptacles 106*a* and 106*b*, the application surface 116*a* will pick the product from the receptacle 106*a* and the application surface 116*b* will pick the product from the receptacle 106*b* simultaneously. Upon application, using applicator 114 onto the skin, the user is able to selectively use the products loaded on the application surface 116*a* and 116*b* and thus avoiding the re-loading of the applicator 114.

In an alternate embodiment of the present invention, at least one of the application surfaces of the applicator element may include brush, flock, elastomeric material and the like. According to yet another embodiment, at least one of the application surfaces of the applicator element may include a material capable of retaining heat or cold during application of the product. The material capable of retaining heat or cold during application of the product includes metals (e.g., aluminum, titanium, steel, nickel, tin, copper, brass, alloys thereof, etc.), ceramics, high-density plastics, composites, or the like. According to an embodiment of the present invention, different application surfaces of the applicator element could be made of different materials that may have different stiffness, have different tactile feel, have different color, have different chemical nature, have different magnetic property, have different temperature property and/or other property.

Figure 7:
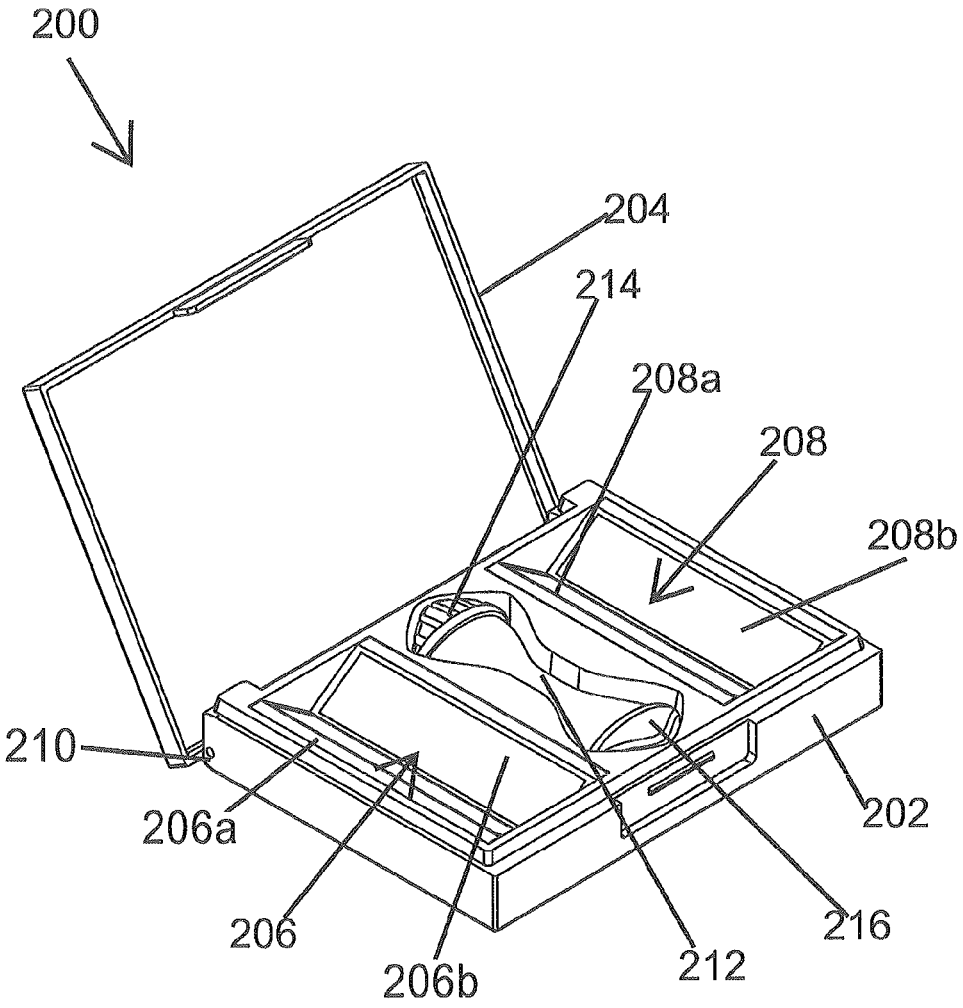
FIG. 7 illustrates the perspective view of the container system 200 according to another embodiment of the present invention.
Figure 8:
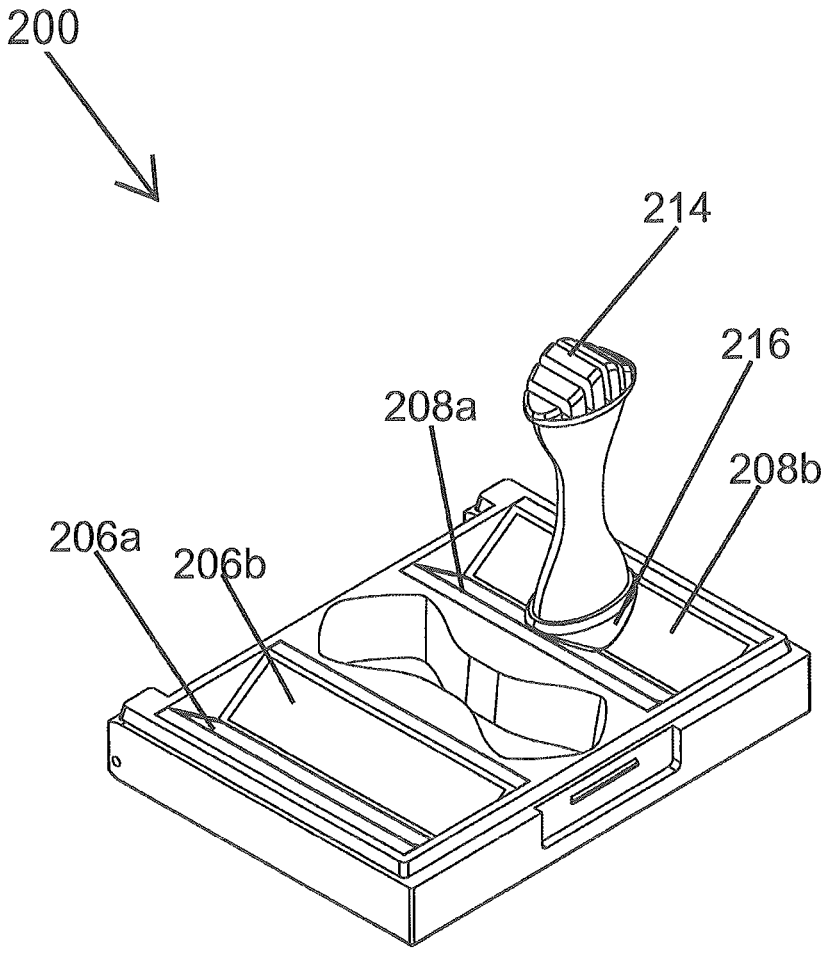
FIGS. 8 and 9 illustrate the perspective view of the base member of the container system 200 of FIG. 7 and further illustrating the dual ended applicator in usage position for picking the products stored in the receptacles of the base member.
Figure 9:
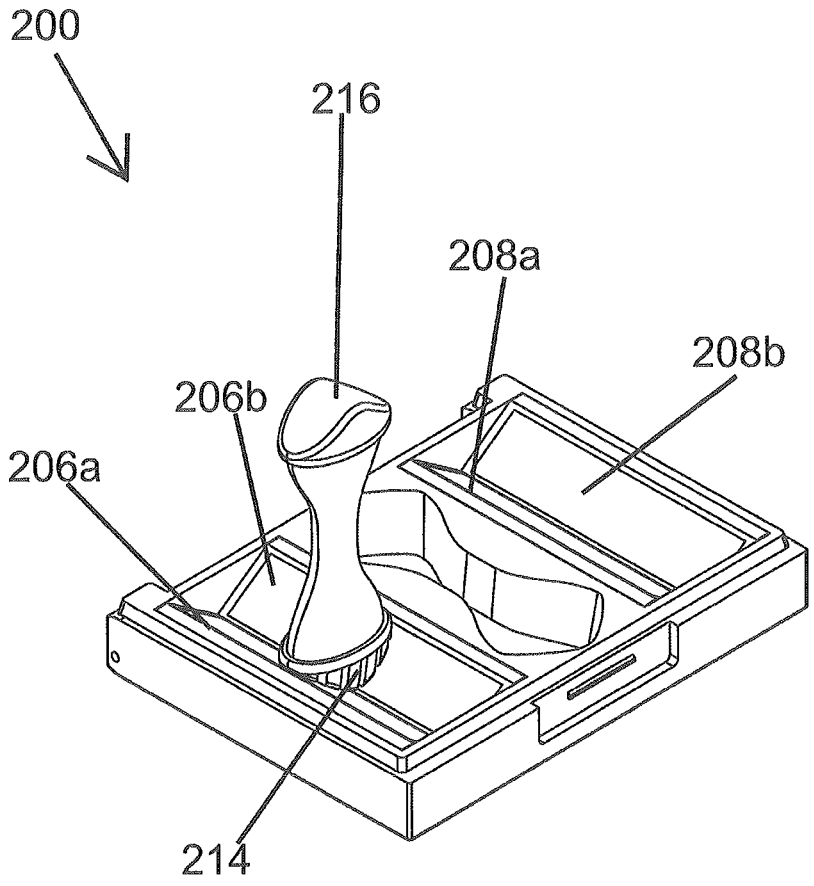

The container system 200 according to one embodiment of the present invention is shown in FIG. 7 to FIG. 9.

As embodied herein and shown in FIGS. 7-9, the container system 200 includes a base member 202, and a cover member 204. The base member 202 includes a pair of receptacle assembly 206 and 208 wherein each of pair of receptacle assembly comprises of two receptacles 206*a*, 206*b* and 208*a*, 208*b* respectively for storing the product. The receptacles 206*a*, 206*b* are configured to hold one type of product and the receptacles 208*a*, 208*b* are configured to hold another type of product having a different physical property and/or color from the product stored in the receptacles 206*a*, 206*b*.

Each of the receptacles 206*a*, 206*b* of the receptacle assembly 206 and each of the receptacles 208*a*, 208*b* of the receptacle assembly 208, of the container system 200 has a bottom wall, a side wall and an open top. Further the receptacles 206*a*, 206*b* of the receptacle assembly 206 and the receptacles 208*a*, 208*b* of the receptacle assembly 208 are arranged such that they are fixed to each other to form a "V" shape cross-section, and the bottom wall of each of the receptacle 206*a*, 206*b* and of the receptacle 208*a*, 208*b* is at a substantially non-zero angle with respect to the base member 202 of the container system 200.

The base member 202 and the cover member 204 are operatively interconnected to each other by means of a locking assembly 210 to provide relative rotational movement. The locking assembly 210 further allows the user to open and lock the cover member 204, and the base member 202 of the container system 200 with respect to each other.

The container system 200 further includes a dual ended applicator 212 having a first applicator element 214 and a second applicator element 216. The first applicator element 214 and the second applicator element 216 are made up of different materials. The first applicator element 214 has grooved application surface which can be used to create a texture on a surface where the product is applied by the user. In an alternate embodiment the first applicator element 214 and the second applicator element 216 may be made up of same material.

The outer shape of the first applicator element 214 is adapted to pick up the product stored in the receptacle assembly 206 comprising of the receptacles 206*a*, 206*b* and the outer shape of the second applicator element 216 is adapted to pick up the product stored in the receptacle assembly 208 comprising of the receptacles 208*a*, 208*b*.

Figure 10A:
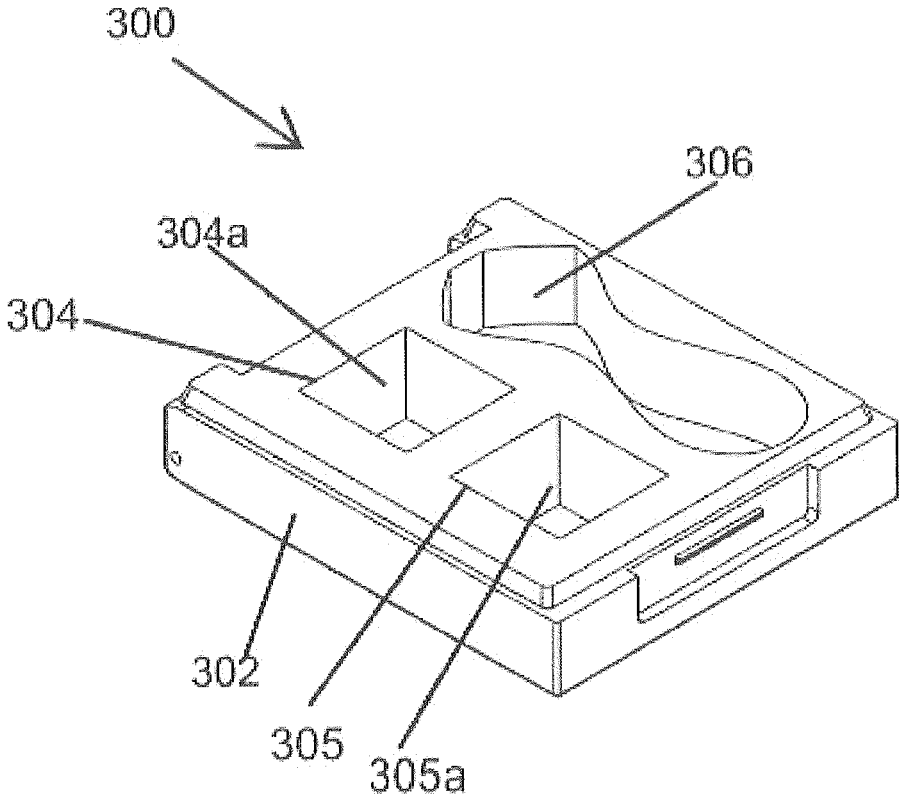
FIGS. 10*a* and 10*b* illustrates the perspective view of the container system 300 according to another embodiment of the present invention.
Figure 10B:
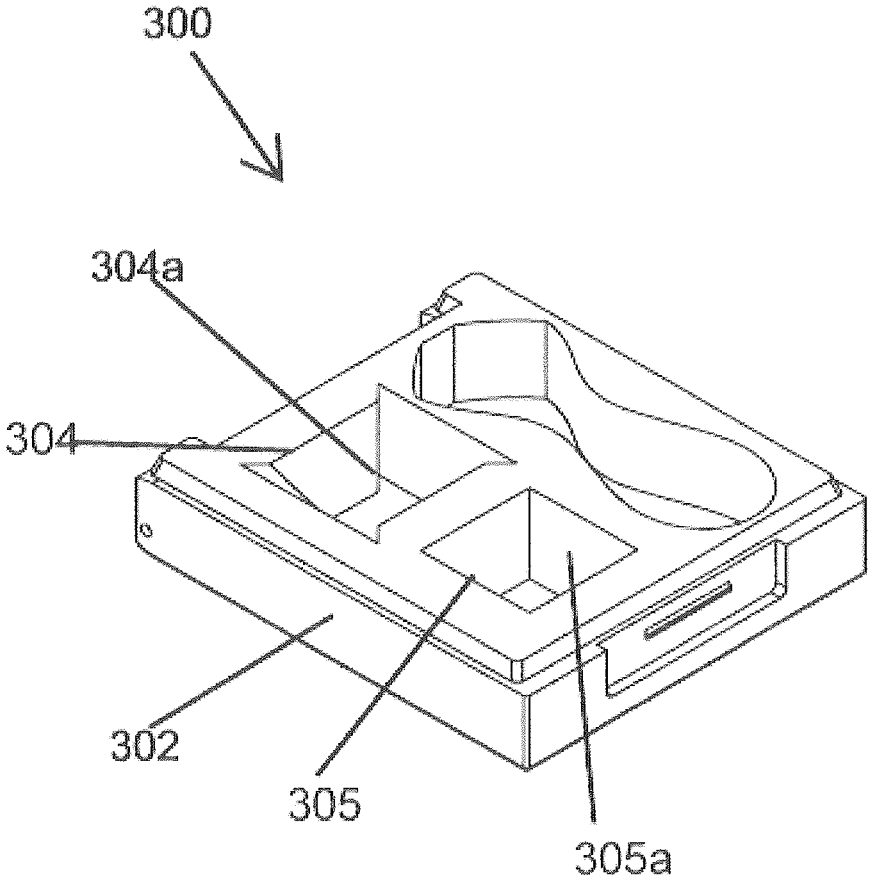
Figure 11A:
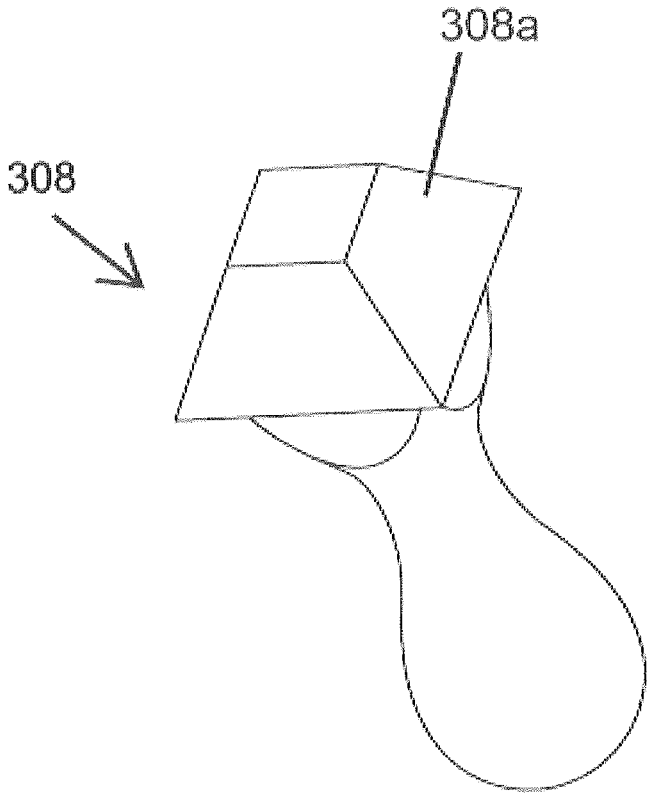
FIGS. 11*a* and 11*b* illustrates the perspective view of the applicator of the container system 300.
Figure 11B:
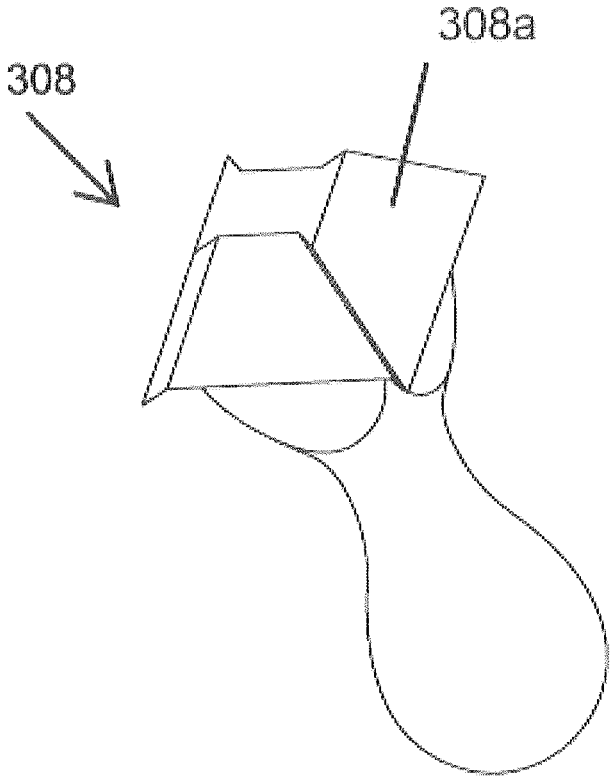

FIGS. 10*a* and 10*b* illustrates the perspective view of the container system 300 according to another embodiment of the present invention. FIGS. 11*a* and 11*b* illustrates the perspective view of the applicator of the container system 300.

As embodied and shown in the FIGS. 10*a* and 11*a*, the container system 300 comprises of a base member 302 having a receptacle assembly 304 and a receptacle assembly 305, and an applicator storage space 306. The receptacle assembly 304 includes five receptacles 304*a*, and the receptacle assembly 305 includes five receptacles 305*a* for storing products. The five receptacles 304*a* are configured to hold one type of product of same color or of different colors. Similarly, the five receptacles 305*a* are configured to hold another type of product of same color or of different colors, the product stored in receptacles 305*a* having a different physical property and/or color from the product stored in the receptacles 304*a*. One of the five receptacles 304*a* and one of the five receptacles 305*a* are positioned at zero degree angle with respect to the base member 302 of the container system, while other receptacles 304*a*, and 305*a* are substantially at non-zero angle with respect to the base member 302 of the container system. The internal shape of receptacle assembly 304 and 305 corresponds to the outer shape of the applicator 308 such that all faces 308*a* of the applicator 308 picks up the products from the receptacle assemblies 304 and 305 storing the products.

As embodied and shown in the FIGS. 10*b* and 11*b*, the shape of the receptacle assembly 304 can be changed or modified by suitable adjustment means (not shown in the figures) and the shape of the applicator 308 can also be changed or modified by suitable adjustment means (not shown in the figures) such that the adjusted shape of the applicator 308 corresponds to the adjusted shape of the receptacle assembly 304 storing the product.

The container system 100 of the present invention may be used to deliver a wide variety of consumer and industrial products related to cosmetic, skin care, hair care, oral care, personal care, pharmaceutical, wound care, orally administrable products, home-care or adhesives.

Further by the invention, the cover member can be transparent, and can have magnifying characteristics on its surface, to enable the user to better view the contents of the compact. Further, the cover member and/or base member are formed of a glass, metallic or polymeric material, such as polycarbonate. In one example, the polymeric base member/cover member is plated or covered with a metallic or other suitable plating or coating.

It is understood that the above description is of preferred exemplary embodiments of the present invention. The invention is not limited to the precise details and conditions disclosed. For example, the shape of the described compact is quadrangular. However, other geometries, such as, circular, oval, hexagonal, and so forth, can also be used.

Various examples of the products where the container system of the present invention could be used are but not limited to cheek blush, cheek plumping gel/cream, lip plumping gel/cream, moisturizer, sunscreen, temporary hair colors, hair styling gel, hair mousse, hair repair cream, hydrating cream, antiseptic and correction cream, acne treatment cream, concealer, blemish concealer, skin treatment cream, hair repair cream, anti-dandruff cream, hair treatment serum, scalp hydrating oils, teeth whitening gel, teeth whitening and teeth lamination solutions, pain relieving cream, antibiotic cream and analgesic cream, antipyretic and analgesic serums/solutions, bleaching agent, fabric softener, stain remover, bleaching agent, adhesive gels.

While the foregoing is directed to embodiments of the present invention, other and further embodiments of the invention may be devised without departing from the basic scope thereof, and the scope thereof is determined by the claims that follow.

What is claimed is:

1. A system comprising:

at least two products;

at least one applicator comprising an applicator element, wherein the applicator element includes at least two application surfaces;

a base member for accommodating at least one receptacle assembly;

wherein the at least one receptacle assembly includes at least two receptacles;

wherein each of the at least two receptacles stores at least one of the at least two products;

wherein each of the at least two receptacles comprises an open top end, a bottom wall and at least one sidewall;

wherein each of the at least two products comprises a top surface;

wherein the at least two products are placed adjacent to each other;

wherein the top surfaces of the at least two products form a non-zero angle $\alpha$ with respect to each other;

wherein the at least one sidewall of one of the at least two receptacles abuts and makes a non-zero angle with the at least one side wall of other of the at least two receptacles;

wherein each of the at least two receptacles further includes at least one flat track extending inwardly and at least along a portion of length of the at least one sidewall that abuts the at least one sidewall of the other of the at least two receptacles;

wherein the at least two application surfaces are placed adjacent to each other to form a non-zero angle $\beta$ with respect to each other;

wherein the angle $\alpha$ and the angle $\beta$ are complementary to each other; and wherein the at least two application surfaces placed adjacent to each other form a shape of the applicator element complementary to a shape formed by the at least two products placed adjacent to each other as well as to a shape formed by the at least two receptacles comprising the flat tracks, to enable simultaneous loading of each of the at least two products on each of the at least two corresponding application surfaces.

2. The system according to claim 1, wherein the angle $\alpha$ is less than 180 degrees and the angle $\beta$ is greater than 180 degrees.

3. The system according to claim 1, wherein the angle $\alpha$ is greater than 180 degrees and the angle $\beta$ is less than 180 degrees.

4. The system according to claim 1, wherein the at least two products placed adjacent to each other may or may not abut each other and wherein the at least two application surfaces adjacent to each other may or may not abut each other.

5. The system according to claim 1, wherein the at least two products are arranged such that their top surfaces make a non-zero angle with respect to the base member.

6. The system according to claim 1, wherein the at least two receptacles are arranged to form a geometric shape selected from V-shape, a triangle shape, a square shape, a pentagon shape, a hexagon shape and a rhombus shape.

7. The system according to claim 1, wherein the at least two products are of same or different colors.

8. The system according to claim 1, wherein the base member includes a two part sub-assembly; the two part sub-assembly comprises a base holder and a base tray, wherein the base holder and the base tray are attached to each other by a fastening means selected from at least one of a tight fit, screw fit, snap-fit and magnet.

9. The system according to claim 8, wherein the base tray includes an empty space on its inner surface for storing a receptacle holder.

10. The system according to claim 1, wherein the at least two application surfaces include material selected from sponge, brush, elastomeric material and flock.

* * * * *